United States Patent [19]

Wang

[11] Patent Number: 4,468,421

[45] Date of Patent: Aug. 28, 1984

[54] ARTIFICIAL CHRISTMAS TREE FOR QUICK FOLDING AND DISPLAY

[75] Inventor: Hai C. H. Wang, Chao-Chou Chen, Taiwan

[73] Assignee: Wong Fok Kee Co., Ltd., Ping-Tung Hsien, Taiwan

[21] Appl. No.: 433,539

[22] Filed: Oct. 8, 1982

[51] Int. Cl.[3] ..... A47G 33/06

[52] U.S. Cl. ..... 428/8; 211/205; 428/20

[58] Field of Search ..... 428/18, 19, 20, 8; 211/205

[56] References Cited

U.S. PATENT DOCUMENTS

| | | | |
|---|---|---|---|
| 3,101,291 | 8/1963 | Lalick | 428/18 X |
| 3,829,349 | 8/1974 | Hermanson | 428/20 X |
| 4,248,916 | 2/1981 | Chase | 428/20 X |
| 4,291,075 | 9/1981 | Puleo | 428/20 X |

*Primary Examiner*—Henry F. Epstein

*Attorney, Agent, or Firm*—Lackenbach, Siegel, Marzullo, Presta & Aronson

[57] ABSTRACT

An artificial Christmas tree for quick folding and display comprises a hollow trunk having reinforced ribs integrally formed along the inner wall within the hollow section and it is erected and mounted on a base support, with a plurality of forked branch-coupling members fitted around various places of the trunk at predetermined levels. Each of the forked branch-coupling members includes a lock ring fitted around the trunk, a lower branch ring coupled with the lock ring, a fastening ring engaged with the upper end of the lock ring, an upper branch ring coupled with both the lower branch ring and the fastening ring, which can be turned for making the adjustment, and a pivotable joint pivotally connected to the upper branches for accommodating the twigs, which can be folded against the trunk for storage or rapidly unfolded for display through pivotal turning of the pivotable joint.

5 Claims, 3 Drawing Figures

ARTIFICIAL CHRISTMAS TREE FOR QUICK FOLDING AND DISPLAY

BACKGROUND OF THE INVENTION

1. Field of the Invention:

This invention relates to a Christmas tree, particularly to an artificial Christmas tree with adjustable branch-coupling members and foldable twig arrangement for quickly adjusting the display pattern as well as for rapidly folding operations so as to cut down the size for easy storage and economic arrangement.

2. Description of the Prior Art:

The known artificial Christmas tree is shown in FIG. 1, which Christmas tree includes a detachable base support 11, a trunk member 12 mounted an the base support 11 and combined with a trunk pipe 122 having several metal pipes 121 axially coupled with each other, and some forked branches 123 separately disposed around the pipes 121, a plurality of twigs 13 detachably inserted into the forked branches 123, and a tree-top cluster 15 detachably mounted at the top recess of the trunk member 12. The drawbacks of this artificial Christmas tree are that: (1) the forked branches extending outward therefrom cannot be folded resulting in a bulky package; and large storage requirements (2) since all the twigs are detachably and respectively assembled thereto, the user has to re-assembly them one by one which is very time consuming, and sometimes the twigs easily get lost or misplaced, and replacement pieces are difficult to obtain as none are usually provided; (3) if the user wishes to re-arrange the display pattern of the tree, he has to take part all of the trunk pipes and twigs and re-assembly them according to his desired display patterns, a very inconvenient operations for the user to perform; and (4) above all, the trunk pipes are all made of metal material, and thus not only are they heavy in structure, but also are costly to manufacture.

SUMMARY OF THE INVENTION

It is accordingly a primary object of this invention to provide an artificial Christmas tree with adjustable branches and twigs for overcoming the above-mentioned defects.

It is another object of this invention to provide an artificial Christmas tree with the branch members disposed around the trunk at predetermined levels in such a way that display patterns can be easily and rapidly adjusted as the user desires.

It is a further object of this invention to provide an artificial Christmas tree with a trunk structure made of light-weight material and provided with reinforced ribs therein so as to reduce the size and the manufacturing cost as well.

According to the present invention, these objects are achieved by providing an artificial Christmas tree for quick folding and display, which comprises a hollow trunk having reinforced ribs integrally formed along the inner wall within the hollow section, and mounted on a base support, and a plurality of forked branch-coupling members fitted around at various places along the trunk. Each of the forked branch-coupling members includes a lock ring fitted around the trunk, a lower branch ring coupled with the lock ring, a fastening ring engaged with the upper end of the lock ring, an upper branch ring coupled with both the lower branch ring and the fastening ring, which can be turned around the trunk for adjusting the positions of the branches thereof, and a pivotable joint pivotally connected to the upper branch ring for accommodating the twigs, which can be folded against the trunk for storage or rapidly unfolded for display through pivotal turning of the pivotable joint.

These and other objects and advantages of the present invention will become clearer from the following description of a preferred embodiment when read in conjunction with the drawings.

DETAILED DESCRIPTION OF THE PREFERRED EMBODIMENT

Figure 1:
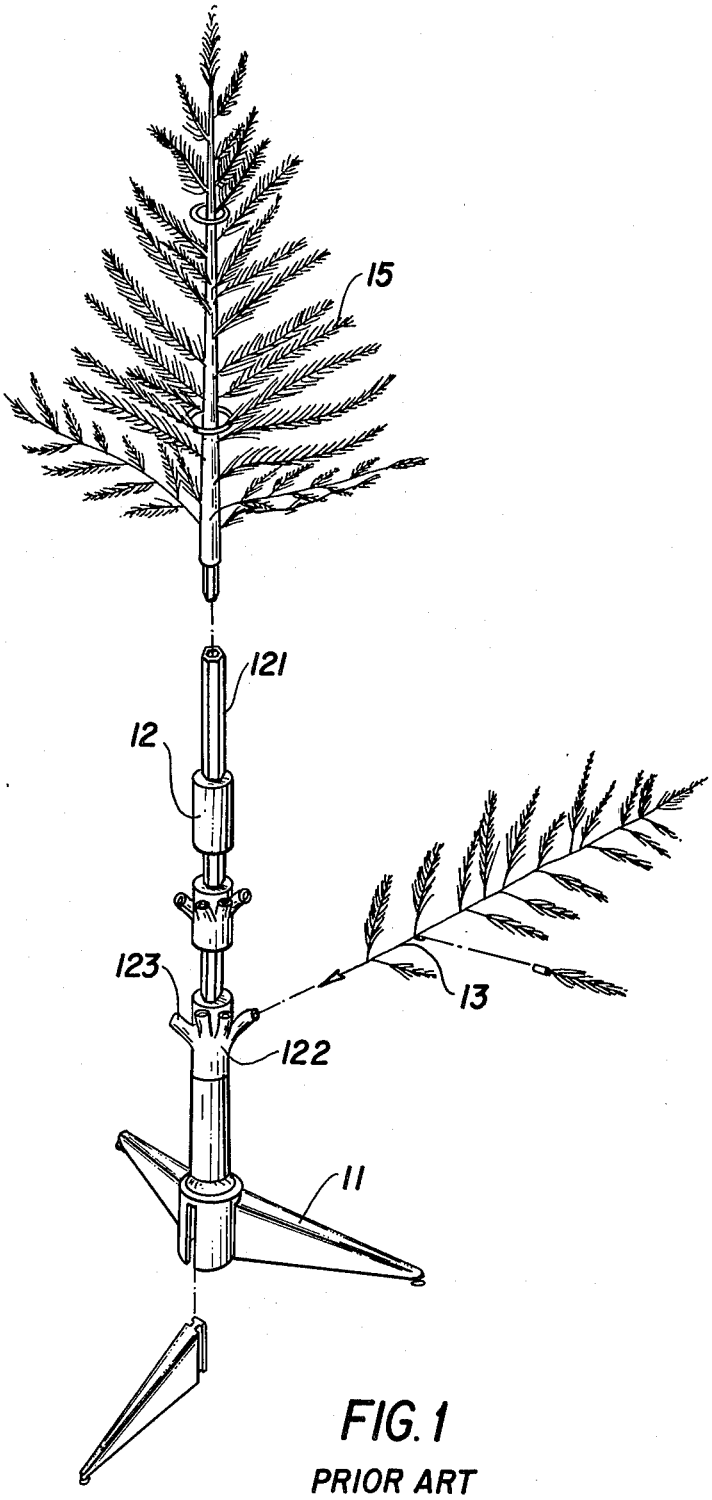
FIG. 1 PRIOR ART
FIG. 1 is a perspective view of a known artificial Christmas tree.
Figure 2:
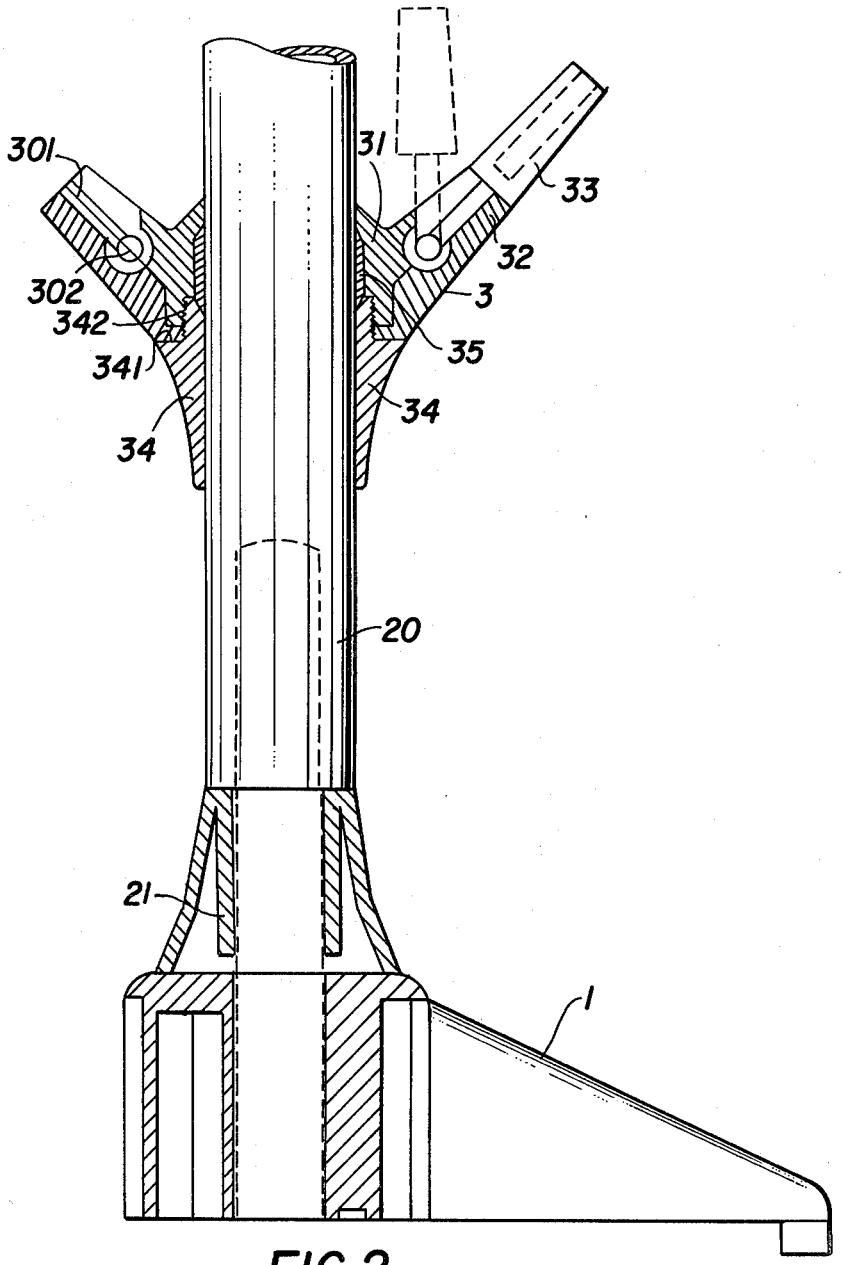
FIG. 2 is a partial sectional view of the trunk and branch members combined according to a preferred embodiment of this invention.
Figure 3:
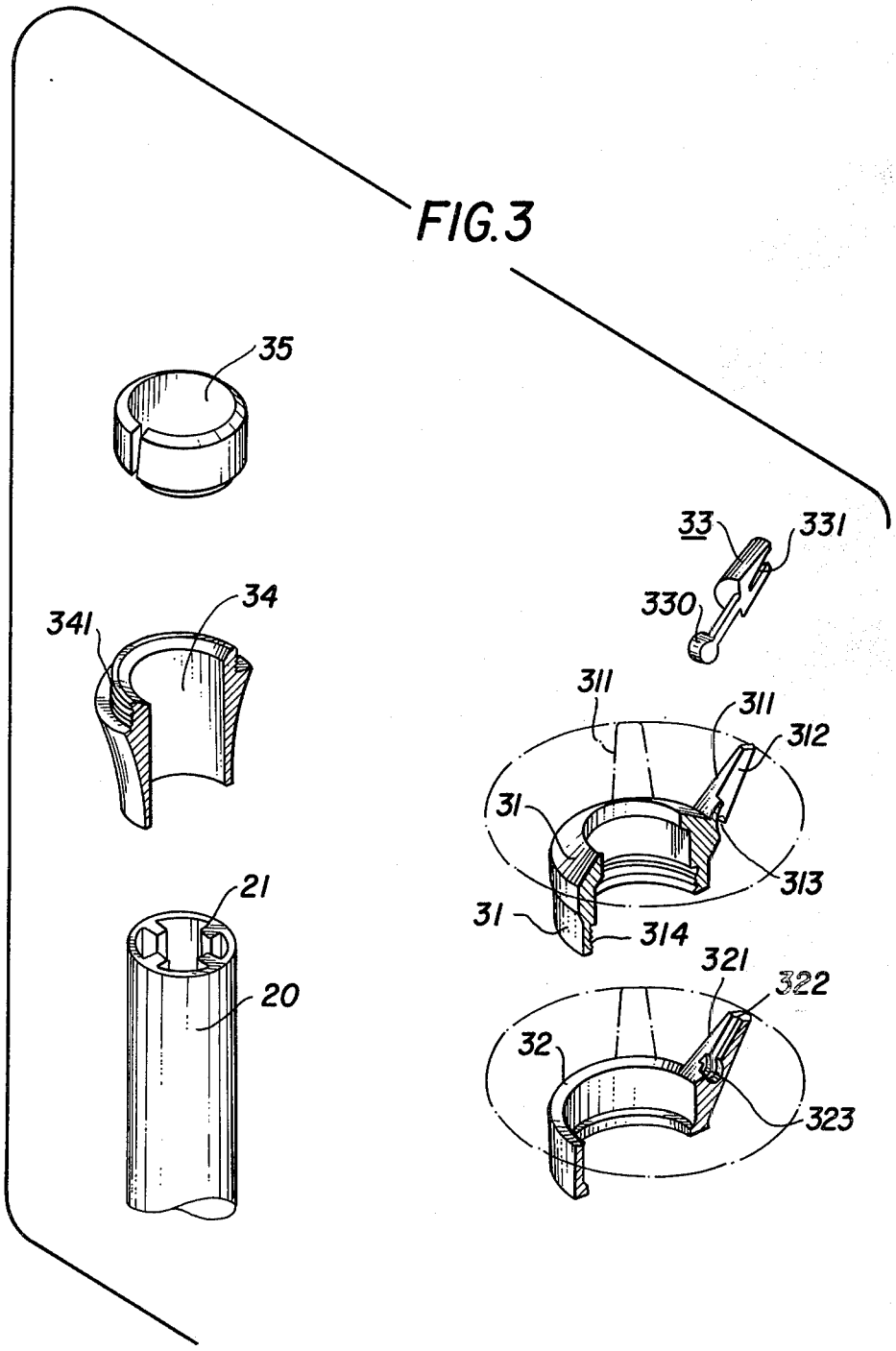
FIG. 3 is a perspective and exploded view of the forked branch coupling member of the preferred embodiment shown in FIG. 2.

Referring to FIGS. 2 and 3, a preferred embodiment of an artificial Christmas tree for quick folding and display according to this invention comprises a hollow trunk 20 having reinforced ribs 21 integrally formed along the inner wall of the trunk 20, which is mounted on a base support 1, and a plurality of forked branch-coupling members 3 disposed around the trunk 20 at predetermined levels. Each of the forked branch-coupling members 3 includes: a lock ring 34, having male thread means 341 formed around the upper end thereof and an annular flange 342 near the lower end of the male threads 341, which is fitted around a proper place of the trunk 20; a lower branch ring 32 having a plurality of strut sockets 321 obliquely extending upwardly therefrom and being coupled with the trunk 20 by resting its lower end upon the annular flange 342 of the lock ring 34, and each of the strut sockets 321 being provided with an axial sliding slot 322 leading to the foundation portion where a flute 323 is formed therein and communicates with the slot 322; a fastening ring 35 having an axial opening thereat fitted around the trunk 20 with its lower end abutting against the upper end of the lock ring 34; and an upper branch ring 31 having female thread means 314 at the lower portion engaged in the inner rim of the lower branch ring 32 around the trunk 20 and screwed to the lock ring 34 through the action of male and female thread means thereof. By means of the upper branch ring 31 and the tapered inner surface of the lock ring 34, the fastening ring 35 is tightly engaged around the trunk 20. The upper branch ring 31 also has a plurality of strut sockets 311 obliquely extending upwardly from the lower portion and corresponding to the positions of the strut sockets 321 formed at the lower branch ring 32. Each of the strut sockets 311 has an axial open slot 312 leading to the foundation portion where a notch 313 is formed therein and communicates with the open slot 312, so that, by combining the lower branch ring 32 and the upper branch ring 31 around the trunk 20, a plurality of retaining sockets 301 and mounting sockets 302 are defined. A pivotable joint 33 having an elongated socket 331 formed at the upper end and a pivotal rod-like axle 330 integrally provided at the tail end are pivotally connected in the mounting socket 302 with the middle portion of the pivotable joint 33 received in the retaining socket 301, so that, the pivotable joint 33 can be pivotally folded against the trunk 20 and also unfolded therefrom. Besides, the socket 331 of the pivotable joint 33 is used for accommodating the stem of the twig. The structure of the base support 1, the twigs and the tree-top cluster are all the same as those of the known Christmas tree shown in FIG. 1; and therefore, an explanation of their structure is omitted.

Utilization of this invention is as follows: When the user wishes to change the appearance of the Christmas tree of this invention, one simply turns loose the lock ring 34, and adjusts the forked branch-coupling members around the trunk 20 so as to quickly re-arrange the display pattern of all the branches and twigs thereof, and then, turns to tight the lock ring 34. If the user intents to package the artificial Christmas tree of this invention for storing, then one first folds the pivotable joints 33 together with the twigs and leaves (not shown) against the trunk 20 (as the dotted line shown in FIG. 2), and then, as described above, turns to loosen the lock ring 34, and move the forked branch-coupling members 3 to a proper place around the trunk 20 so as to cut the tree down to a packaged size for storing purpose without taking the trouble to perform complete disassembly operations. For displaying the Christmas tree of this invention, it can be done quickly just by reversing the order of packaging as mentioned above.

While a preferred embodiment of this invention has been illustrated and described, it is to be understood that numerous changes and modifications may be made therein without departing from the scope of this invention as defined in the appended claims.

I claim:

1. An artificial Christmas tree for quick folding and display having a detachable base support and a tree-top cluster and twigs for display, comprising in combination;

a hollow trunk with reinforced ribs integrally formed along the inner wall of said hollow trunk;

a plurality of forked branch-coupling members fitted around said trunk at predetermined levels; and straight joint means pivotally connected to said forked branch-coupling members for supporting the twigs, so that, by moving said forked branch-coupling members around said trunk, display patterns of said tree can be easily adjusted, and, by pivoting said joint means, said twigs may be folded against said trunk for easy storage and packing;

each said forked branch-coupling members comprising a lock ring having an annular flange and thread means at one end thereof;

a lower branch ring having at least one strut socket formed at the upper end and obliquely extending outwardly therefrom disposed around said trunk with the lower end abutting against the annular flange of said lock ring;

a fastening ring having an axial opening thereof fitted around said trunk with the lower and abutting against the upper end of said lock ring; and an upper branch ring having at least one strut socket formed at the lower portion and obliquely extending outwardly therefrom corresponding to the positions of the strut socket of said lower branch ring; and thread means provided in the lower end fitted aroung said trunk by engaging the lower portion in the inner rim of said lower branch ring and being connected to said lock ring through cooperating thread means, so that, by turning said lock ring, said branch-coupling members can easily be moved around said trunk for adjusting the display pattern of said tree as may be desired.

2. An artificial Christmas tree as claimed in claim 1, wherein said strut socket of said lower branch ring has an axial sliding slot formed therein and a flute provided at the lower end communicating with said sliding slot.

3. An artificial Christmas tree as claimed in claim 1, wherein said strut socket of said upper branch ring has an axial open slot formed therein and a notch provided at the lower end communicating with said open slot.

4. An artificial Christmas tree as claimed in claim 1, 2, or 3, wherein said strut socket of said upper branch ring corresponds to the strut socket of said lower branch ring for defining a retaining socket and a mounting socket thereat.

5. An artificial Christmas tree as claimed in claim 4, wherein said straight joint means comprises;

a joint body;

an elongated socket axially formed in said joint body for receiving the twigs thereof; and a pivotal rod-like axle integrally provided at one end thereof and movably connected to said mounting socket defined by said lower branch ring and said upper branch ring so as to be folded against said trunk during storage and rotated therefrom for display.

* * * * *